US006050114A

United States Patent [19]

Park

[11] Patent Number: 6,050,114

[45] Date of Patent: Apr. 18, 2000

[54] LATCH ASSEMBLY OF PADLOCK FOR SLIDING DOORS

[76] Inventor: Hyok Goo Park, RM 801, No. 801 Byuksan Apt., 1267 Kwonsun-dong, Kwonsun-ku, Suwon City, Kyonggi-do, Rep. of Korea

[21] Appl. No.: 09/072,353

[22] Filed: May 5, 1998

[51] Int. Cl.[7] ..... E05B 65/48

[52] U.S. Cl. ..... 70/2; 292/281; 292/DIG. 11

[58] Field of Search ..... 70/2; 292/281–282, 292/283, 284, DIG. 11

[56] References Cited

U.S. PATENT DOCUMENTS

| | | | |
|---|---|---|---|
| 3,852,981 | 12/1974 | Koning | 70/2 |
| 4,322,102 | 3/1982 | Lindblom | 292/281 |
| 4,569,545 | 2/1986 | Hartmann et al. | 292/281 |
| 4,581,907 | 4/1986 | Eberly | 70/54 |
| 4,745,783 | 5/1988 | Poe | 70/2 |
| 4,879,889 | 11/1989 | DeForrest, Sr. | 70/56 |
| 5,409,276 | 4/1995 | Engasser | 292/281 |

*Primary Examiner*—B. Dayoan
*Assistant Examiner*—John B. Walsh
*Attorney, Agent, or Firm*—Birch, Stewart, Kolasch & Birch, LLP

[57] ABSTRACT

A latch assembly of a padlock for sliding doors is provided with male and female plate members capable of effectively engaging with each other. The male member includes of a first mounting part having a plurality of screw holes and mounted to either a doorframe or a door, and a first bending part perpendicularly bent from the first mounting part. The female plate member is mounted to the remaining one of the door and the doorframe so as to vertically engage with the male member. The female plate member includes of a second mounting part having a plurality of screw holes and a second bending part vertically bent from the second mounting part. Therefore, the screw holes of the male and female plate members are respectively hidden by the second and first bending parts when the door is locked by a padlock.

10 Claims, 5 Drawing Sheets

LATCH ASSEMBLY OF PADLOCK FOR SLIDING DOORS

BACKGROUND OF THE INVENTION

1. Field of the Invention

The present invention relates, in general, to a latch assembly of a padlock for sliding doors. More particularly, the present invention relates to a latch assembly provided with male and female plate members capable of effectively engaging with each other and preventing a trespasser from drawing the fixing screws of the latch assembly out of a door or doorframe when the two members engage with each other.

2. Description of the Prior Art

As well known to those skilled in the art, doors are typically classified into sliding doors, swinging doors, revolving doors, etc. Particularly, the sliding doors are individually designed for sliding along the threshold of a doorframe to the left or right, thereby improving the practical use of a space.

However, the above sliding doors are problematic in that it is difficult to mount a locking means to the sliding doors different from swinging doors.

In an effort to solve the above problem, a typical latch assembly of a padlock for sliding doors is proposed. For example, FIG. 9 is a perspective view illustrating a latch assembly in accordance with the prior art.

As shown in the drawing, the latch assembly comprises a pair of plate members. That is, the typical latch assembly includes a male plate member mounted to a doorframe and a female plate member mounted to a door at a position opposite to the male plate member. Typically, a plurality of screws are used for mounting the male or female plate member to the doorframe or door.

When the door is locked by a padlock after closing the door as shown in FIG. 9, the screw heads, driven in the door with the female plate member, are exposed to the exterior of the door because the door meets the doorframe at right angles. As a result, a trespasser may easily draw the screws out of the door by a tool, such as a screw driver, so as to open the door without permission.

In addition, the male plate member includes a hook part, which has a "U"-shaped configuration and is welded to one side wall. The female plate member comprises a coupling part and a mounting part screwed to the side wall of the door. Also, the coupling part is hinged to the mounting part of the female plate member by a hinge pin, thus causing a manufacturing process to be complicated and reducing production efficiency.

Furthermore, in order to easily insert the hook part of the male plate member into the coupling part of the female plate member, the coupling part has to have a long length. Therefore, an aperture is formed between the side wall of the doorframe and the coupling part of the female plate member when the door is locked.

SUMMARY OF THE INVENTION

Accordingly, the present invention has been made with the above problems occurring in the prior art in mind. Therefore, an object of the present invention is to provide a latch assembly of a padlock for sliding doors having male and female plate members capable of effectively engaging with each other and preventing a trespasser from drawing the fixing screws of the latch assembly out of the door or doorframe when the two members engage with each other, thus having improved safety.

In order to accomplish the above objects, a latch assembly of a padlock for sliding doors according to the primary embodiment of this invention comprises: a male member consisting of: a first mounting part having a plurality of screw holes and mounted to either a doorframe or a door; and a first bending part perpendicularly bent from said first mounting part; and a female plate member mounted to the remaining one of the door and doorframe so as be to vertically engaged with the male member, the female plate member consisting of: a second mounting part having a plurality of screw holes and mounted to the remaining one of the door and doorframe; and a second bending part vertically bent from the second mounting part, so the screw holes of the male and female plate members are respectively hidden by the second and first bending parts when the door is locked by a padlock.

A latch assembly of a padlock for sliding doors according to the second embodiment of this invention comprises: a male member consisting of: a first mounting part having a plurality of screw holes and horizontally mounted to a doorframe; and a first bending part perpendicularly bent from the first mounting part; and a female plate member having a "⊐"-shaped configuration and mounted to a door, and engaging with the male member, the female plate member consisting of: a second mounting part having a plurality of screw holes and mounted to the door; and a pair of second bending parts perpendicularly bent from both upper and lower ends of the second mounting part in the same direction, and having the same profile.

A latch assembly of a padlock for sliding doors according to the third embodiment of this invention comprises: a pair of coupling members respectively mounted to a door and a doorframe through a plurality of screw holes, each of said coupling members having a "⊐"-shaped configuration and engaging with each other at right angles so as to hide the screw holes when the door is locked by a padlock.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above object, and other features and advantages of the present invention will be more clearly understood from the following detailed description taken in conjunction with the accompanying drawings, in which.

DESCRIPTION OF THE PREFERRED EMBODIMENT

Figure 1:
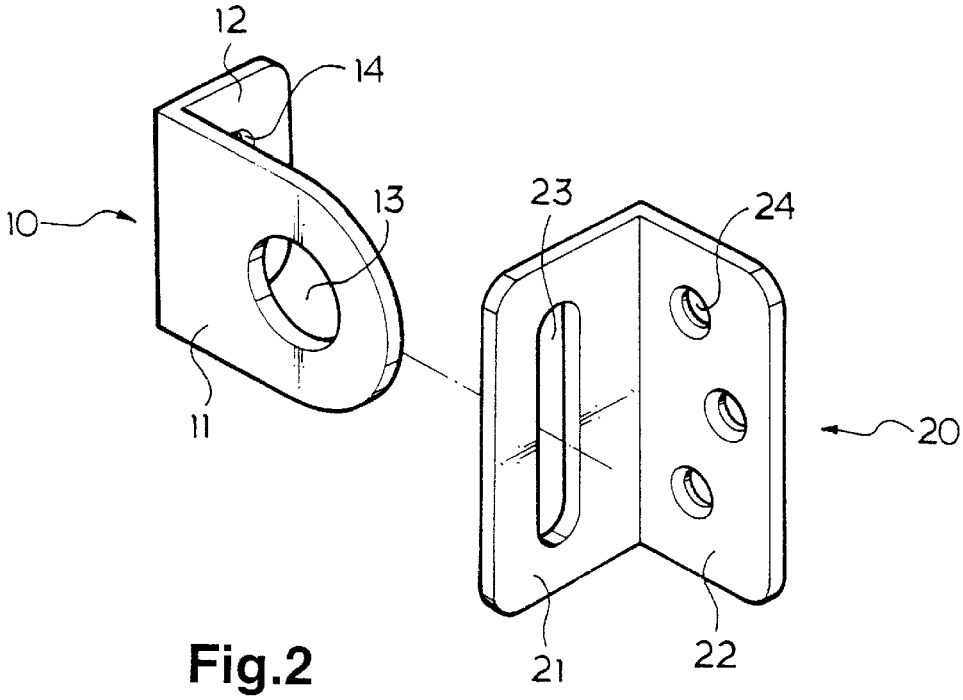
FIG. 1 is an exploded perspective view of a latch assembly of a padlock in accordance with the primary embodiment of the present invention.
Figure 2:
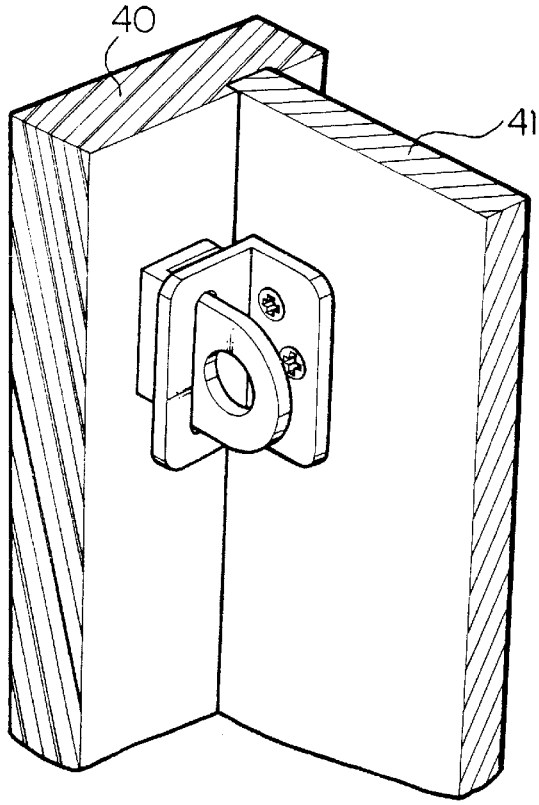
FIG. 2 is a perspective view showing the latch assembly of FIG. 1, mounted to the door and doorframe.

FIGS. 1 and 2 are views illustrating the construction of a latch assembly for a padlock for sliding doors in accordance with the primary embodiment of the present invention.

As shown in FIGS. 1 and 2, the latch assembly of this invention comprises a male plate member 10 and a female plate member 20, mating with each other. Such a male plate member 10 is vertically mounted to one side wall of a doorframe 40, while the female plate member 20 is vertically mounted to a door 41 at a position corresponding to the male plate member 10.

With reference to FIG. 1, the male plate member 10 comprises a first mounting part 12 and a first bending part 11 perpendicularly bent from one end of the first mounting part 12. In addition, a locking hole 13 is formed on the bending part 11 of the male plate member 10, while a plurality of screw holes 14 are formed on the first mounting part 12.

In the same manner as described for the male plate member 10, the female plate member 20 comprises a second mounting part 22 and a second bending part 21 perpendicularly bent from the second mounting part 22. Also, an inserting hole 23 is longitudinally formed on the second bending part 21 of the female plate member 20, while a plurality of screw holes 24 are formed on the second mounting part 22. In such a case, the longitudinal inserting hole 23 has a length and width suitable for allowing the first bending part 11 of the male plate member 10 to easily pass through.

When locking the door 41 by a padlock (not shown), the door 41 is closed as shown in FIG. 2 with the first bending part 11 of the male plate member 10 being inserted into the inserting hole 23 of the female plate member 20. Therefore, when the door 41 is locked by the padlock, the screw holes 24 of the female plate member 20 are effectively hidden by the inserted bending part 11 of the male plate member 10. As a result, it is very difficult for a trespasser to draw the screws of the latch assembly out of the male or female plate member, thus preventing such a trespasser from entering a room without permission.

FIGS. 3 to 5B are views illustrating the construction of a latch assembly of a padlock for sliding doors in accordance with the second embodiment of this invention.

Figure 3:
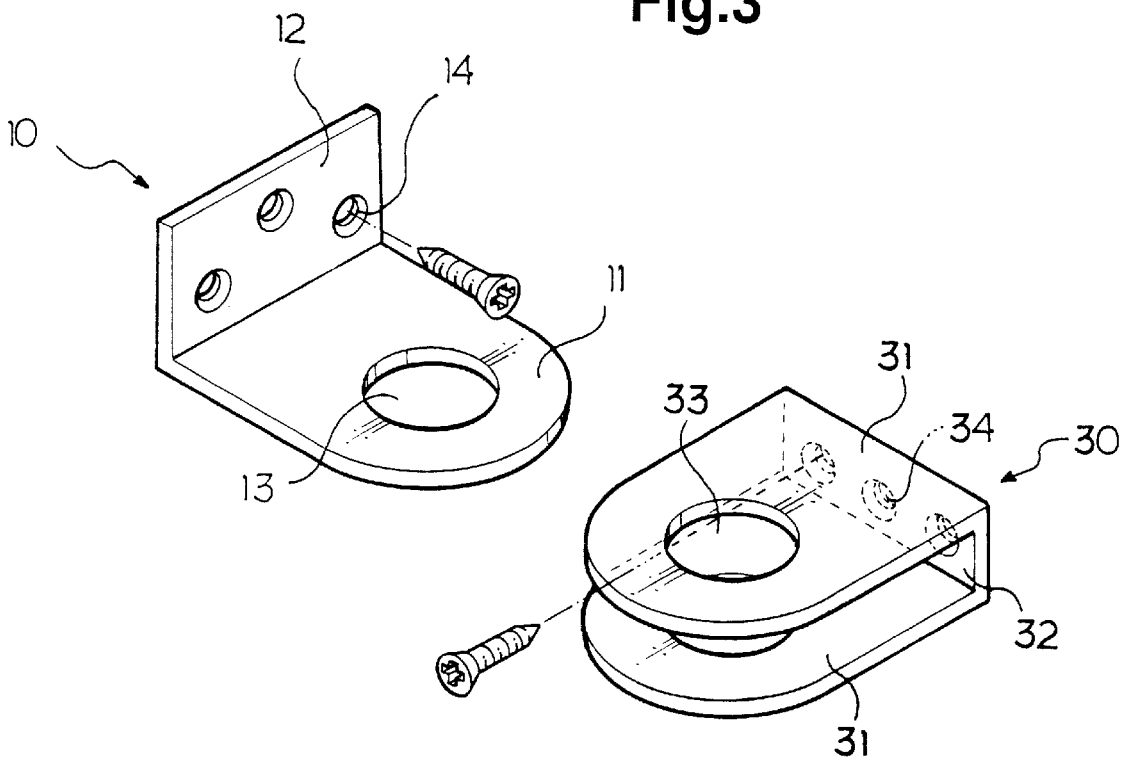
FIG. 3 is an exploded perspective view of a latch assembly of a padlock in accordance with the second embodiment of the present invention.

In this embodiment, the latch assembly comprises male and female plate members 10 and 30. The construction of the male plate member 10 remains the same as that of FIG. 1, but the male plate member 10 is horizontally mounted to a doorframe 40 different from the primary embodiment. The female plate member 30, having a "⊐"-shaped configuration, comprises a pair of second bending parts 31 and a second mounting part 32. The second bending parts 31 are perpendicularly bent from the upper and lower ends of the second mounting part 32 as shown in FIG. 3. In this case, the second bending parts 31 have the same profile and are bent in the same direction.

Figure 4:
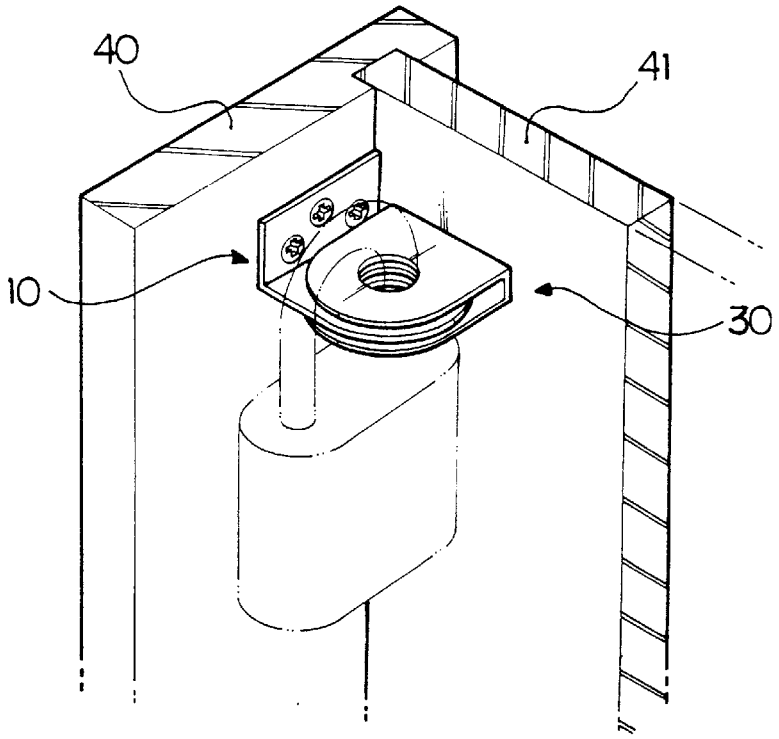
FIG. 4 is a perspective view illustrating the latch assembly of FIG. 3, mounted to the door and doorframe.
Figure 5:
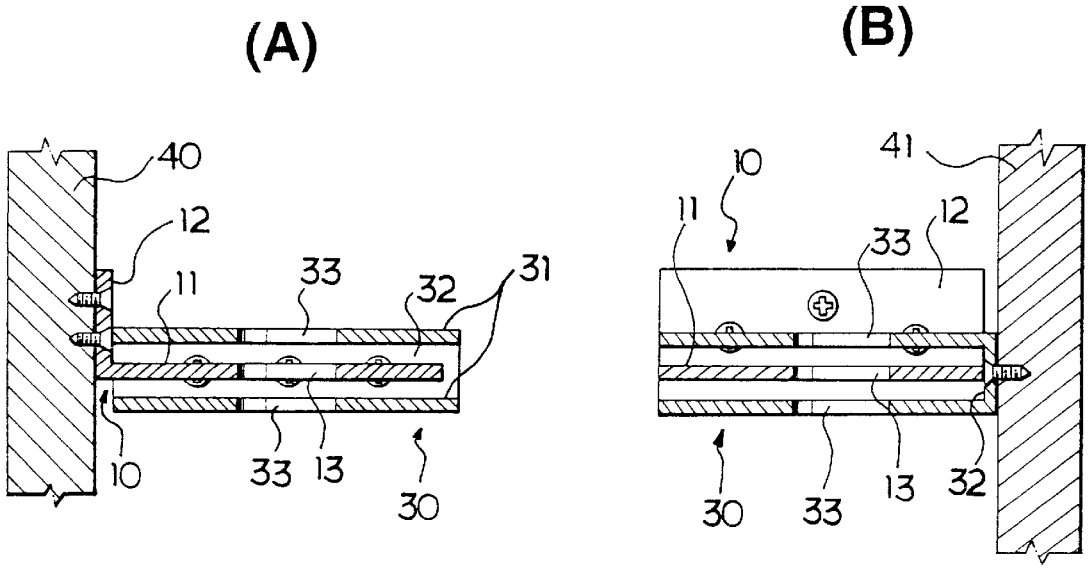
FIG. 5A is a cross-sectional view of the latch assembly of FIG. 4.
FIG. 5B is a vertical-sectional view of the latch assembly of FIG. 4.
Figure 6:
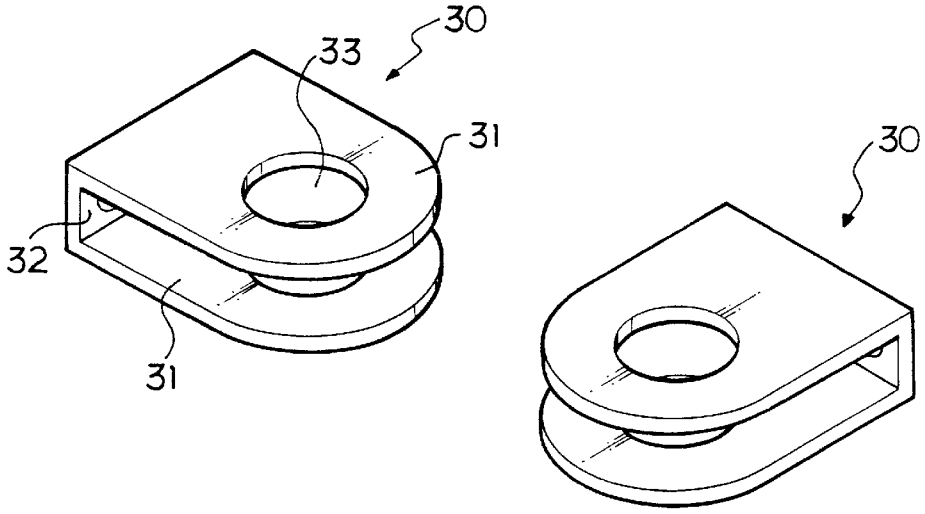
FIG. 6 is an exploded perspective view of a latch assembly of a padlock in accordance with the third embodiment of the present invention.

In addition, a plurality of screw holes 34 are formed on the second mounting part 32, while a pair of inserting holes 33 are individually formed on each of the second bending parts 31 of the female plate member 30. In such a case, the locking hole 13 of the male plate 10 has the same diameter as that of the second inserting holes 33. Therefore, a door 41 can be easily locked by a padlock passing through the locking and inserting holes 13 and 33 as shown in FIG. 4.

Therefore, when the door 41 is locked by the padlock, the screw holes 34 of the female plate member 30 effectively hidden by the inserted bending part 11 of the male plate member 10. Also, the screw holes 14 of the first mounting part 12 of the male plate member 10 are hidden by the bending part 31 located at the upper position of the female plate member 30. As a result, it is very difficult for a trespasser to draw the screws of the latch assembly out of the male or female plate member, thus preventing such a trespasser from entering a room without permission.

FIGS. 6 to 8B are views illustrating the construction of a latch assembly of a padlock for sliding doors in accordance with the third embodiment of this invention.

In this embodiment, the latch assembly comprises a pair of coupling members 30. Each of the coupling members 30 has the same profile as the female plate member of FIG. 3, but the two coupling members 30 are respectively mounted to the doorframe 40 and the door 41 so as to vertically engage with each other.

Figure 7:
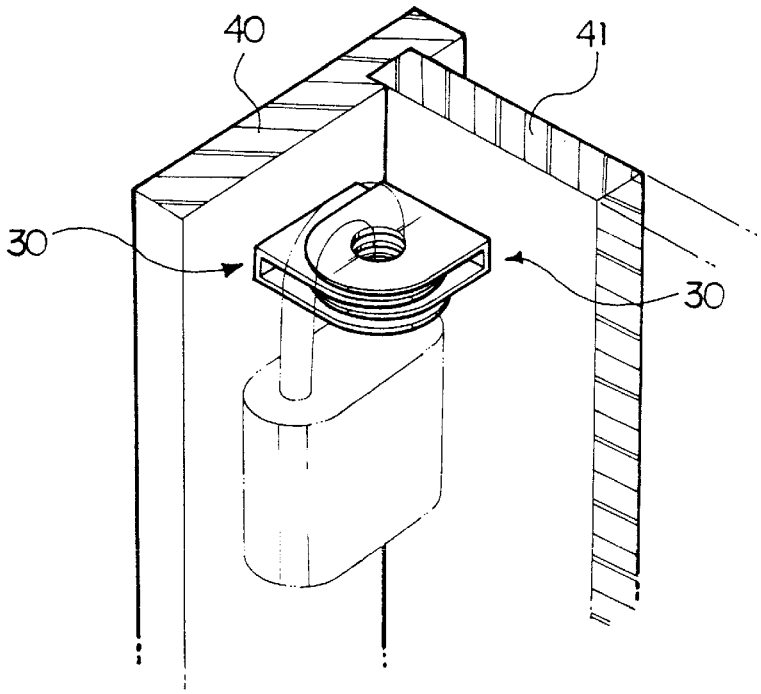
FIG. 7 is a perspective view illustrating the latch assembly of FIG. 6, mounted to the door and doorframe.
Figure 8:
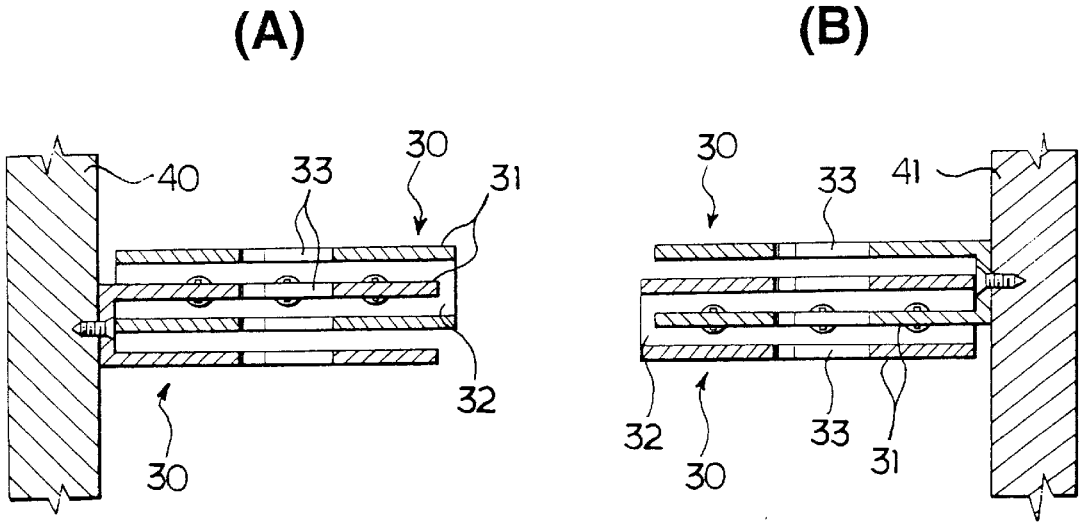
FIG. 8A is a cross-sectional view of the latch assembly of FIG. 6.
FIG. 8B is a vertical-sectional view of the latch assembly of FIG. 6.
Figure 9:
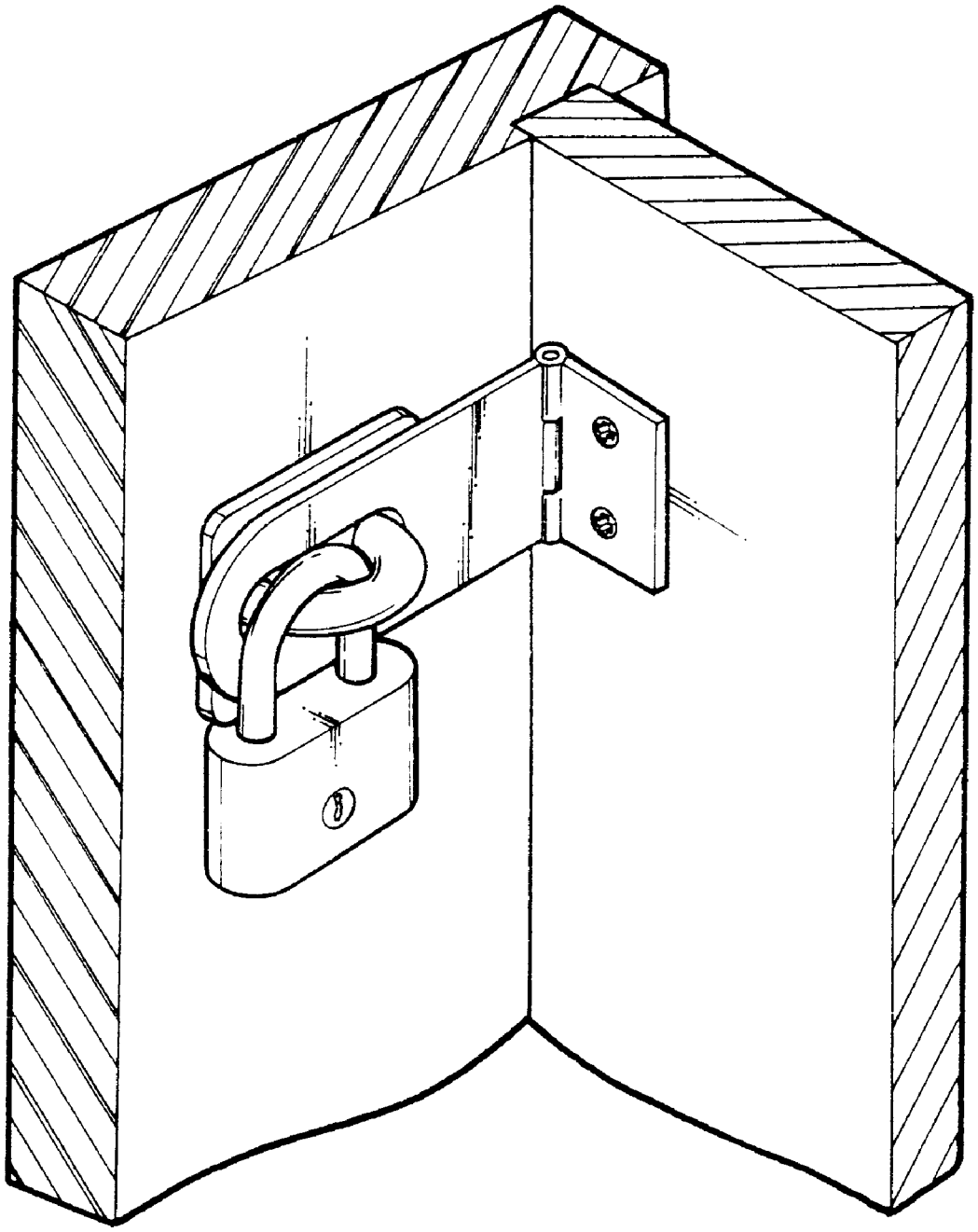
FIG. 9 is a perspective view illustrating a typical latch assembly mounted to the door and doorframe.

Therefore, when the door 41 is locked by the padlock, the screw holes 34, formed on the two coupling members 30, are effectively hidden as shown in FIG. 7. As a result, it is very difficult for a trespasser to draw the screws of the latch assembly out of the male and female plate members.

As mentioned above, the latch assembly of this invention has male and female plate members capable of effectively engaging with each other. Therefore, a plurality of screws, mounted to the door and doorframe while passing through the screw holes of the male and female plate members, are effectively hidden, thereby preventing a trespasser from drawing the fixing screws of the latch assembly out of the door or doorframe when the two members engage with each other. The latch assembly of this invention thus has improved safety.

In addition, the male and female plate members of this invention are simply made of a steel plate through a punching and bending process, thus reducing production cost.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A latch assembly of a padlock for sliding doors, comprising:

a male plate member consisting essentially of:

a first mounting part; said first mounting part being a flat plate and having a plurality of screw holes formed therethrough for mounting the first mounting part to either a doorframe or a door; and a first bending part perpendicularly bent from said first mounting part, said first bending part being immovable with respect to said first mounting part; and a female plate member for mounting to a remaining one of the door and doorframe so as to vertically engage with said male member, said female plate member consisting essentially of:

a second mounting part, said second mounting part being a flat plate and having a plurality of screw holes formed therethrough for mounting the second mounting part to the remaining one of the door and doorframe; and a second bending part vertically bent from said second mounting part, said second bending part being immovable with respect to said second mounting part, wherein the screw holes of said male and female plate members are respectively hidden by said second and first bending parts when the door is locked by a padlock.

2. The latch assembly as claimed in claim 1, wherein a locking hole is formed on the first bending part of said male plate member, while an inserting hole is longitudinally formed on the second bending part of said female plate member.

3. The latch assembly as claimed in claim 2, wherein said inserting hole has a length and width suitable for allowing said first bending part to easily pass through.

4. A latch assembly of a padlock for sliding doors, comprising:

a male plate member consisting essentially of:

a first mounting part, said first mounting part being a flat plate and having a plurality of screw holes formed therethrough for horizontally mounting the first mounting part to a doorframe; and a first bending part perpendicularly bent from said first mounting part, said first bending part being immovable with respect to said first mounting part; and a female plate member having a "⊐"-shaped configuration for mounting to a door, said female plate member engageable with said male member, said female plate member consisting essentially of:

a second mounting part, said second mounting part being a flat plate and having a plurality of screw holes formed therethrough for mounting the second mounting part to the door; and a pair of second bending parts perpendicularly bent from upper and lower ends of said second mounting part in the same direction, and having the same profile, each of said pair of second bending parts being immovable with respect to said second mounting part.

5. A latch assembly of a padlock for sliding doors, comprising:

a pair of coupling members respectively mountable to a door and a doorframe through a plurality of screw holes, each of said coupling members having a "⊐"-shaped configuration and engageable with each other at right angles so as to hide the screw holes when the door is locked by a padlock, each of said coupling members including a mounting part and a pair of bending parts perpendicularly bent from upper and lower ends of said mounting part, each of said pair of bending parts being immovable with respect to said mounting part.

6. The latch assembly as claimed in claim 5, wherein each of said mounting parts includes a plurality of screw holes formed therethrough for mounting a respective one of the coupling members to the door and doorframe.

7. A latch assembly of a padlock for sliding doors, comprising:

a male plate member comprising:

a first mounting part; said first mounting part being a flat plate and having a plurality of screw holes formed therethrough for mounting the first mounting part to either a doorframe or a door; and a first bending part perpendicularly bent from said first mounting part said first bending part being immovable with respect to said first mounting part; and a female plate member for mounting to a remaining one of the door and doorframe so as to vertically engage with said male member, said female plate member comprising:

a second mounting part, said second mounting part being a flat plate and having a plurality of screw holes formed therethrough for mounting the second mounting part to the remaining one of the door and doorframe; and a second bending part vertically bent from said second mounting part, said second bending part being immovable with respect to said second mounting part, wherein the screw holes of said male and female plate members are respectively hidden by said second and first bending parts when the door is locked by a padlock.

8. The latch assembly as claimed in claim 7, wherein a locking hole is formed of the first bending part of said male plate member, while an inserting hole is longitudinally formed on the second bending part of said female plate member.

9. The latch assembly as claimed in claim 8, wherein said inserting hole has a length and width suitable for allowing said first bending part to easily pass through.

10. A latch assembly of a padlock for sliding doors, comprising:

a male plate member comprising:

a first mounting part, said first mounting part being a flat plate and having a plurality of screw holes formed therethrough for horizontally mounting the first mounting part to a doorframe; and a first bending part perpendicularly bent from said first mounting part, said first bending part being immovable with respect to said first mounting part; and a female plate member having a "⊐"-shaped configuration for mounting to a door, said female plate member engageable with said male plate member, said female plate member comprising:

a second mounting part, said second mounting part being a flat plate and having a plurality of screw holes formed therethrough for mounting the second mounting part to the door; and a pair of second bending parts perpendicularly bent from upper and lower ends of said second mounting part in the same direction, and having the same profile, each of said pair of second bending parts being immovable with respect to said second mounting part.

* * * * *